United States Patent [19]

Barber et al.

[11] 4,351,433

[45] Sep. 28, 1982

[54] CIGARETTE PACKETS

[75] Inventors: Donald J. Barber; Douglas G. Meaden, both of London, England

[73] Assignee: Molins PLC, London, England

[21] Appl. No.: 107,483

[22] Filed: Dec. 26, 1979

[30] Foreign Application Priority Data

Dec. 27, 1978 [GB] United Kingdom ..... 50059/78

[51] Int. Cl.[3] ..... B65D 85/10; B65D 85/12

[52] U.S. Cl. ..... 206/264; 206/606; 206/627; 206/630

[58] Field of Search ..... 206/264, 268, 271, 274, 206/276, 615, 605, 606, 608, 610, 609, 612, 613, 614, 627, 630

[56] References Cited

U.S. PATENT DOCUMENTS

| | | | |
|---|---|---|---|
| 2,789,752 | 4/1957 | Will | 206/264 |
| 3,086,692 | 4/1963 | Cage | 206/614 |
| 3,387,136 | 6/1968 | Williamson | 206/264 |
| 3,402,877 | 9/1968 | Pinkham | 206/264 |
| 3,533,550 | 10/1970 | Benzon-Peterson . | |
| 3,539,093 | 11/1970 | Massengill | 206/614 |

FOREIGN PATENT DOCUMENTS 1023933 3/1966 United Kingdom .

*Primary Examiner*—Joseph Man-Fu Moy
*Attorney, Agent, or Firm*—John C. Smith, Jr.

[57] ABSTRACT

A soft pack made from a composite laminate blank has inner and outer films 6, 8 of polyethylene laminated to a paper substrate 4. The outer film is formed with an integral tear strip 26 thicker than the remaining film.

The blank is folded as a tube around the cigarette bundle, the ends closed by the conventional tuck-and-fold closure and then heat sealed. To one side of the revenue stamp 20 is provided a perforated band 24 which is torn away on pulling of the tear strip.

9 Claims, 2 Drawing Figures

FIG. 1
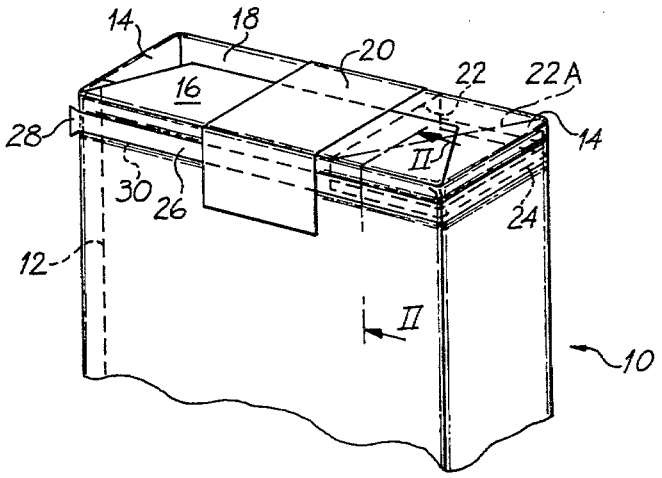
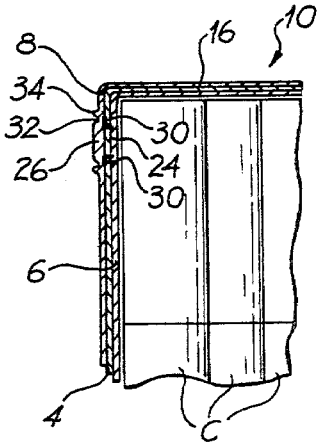
FIG. 2

CIGARETTE PACKETS

This invention concerns improvements in or relating to the type of cigarette packets known as soft packs or American packs, which are made of relatively thin materials, in contrast with more rigid packets such as hinged lid packets.

It is an object of the invention to provide a packet which, though having an appearance similar to a conventional soft packet, is made of fewer constituent components so that it can be produced more cheaply.

According to the invention there is provided a cigarette packet formed from a composite rectangular blank having an outer film of thermoplastic material laminated to a fibrous substrate, such as paper, said blank when erected providing two opposed large faces, two narrow sides, a sealed longitudinal seam extending down one of said faces or one of said sides, a top closure and a bottom closure, each of said closures being formed by tucking in material at the respective ends of the narrow sides and successively folding over and sealing together material at the respective ends of the large faces, a perforated band formed in said fibrous substrate below said top closure and extending across at least one of said narrow sides and part of one of said large faces, and a tear strip integrally formed in said outer film and secured over said perforated band, so as to enable said band to be torn open to gain access to the cigarettes in the packet.

An example of a packet according to the invention will now be described with reference to the accompanying drawings, in which:

FIG. 1 is a perspective view of the top of the packet, and

FIG. 2 is a section taken on the line II—II of FIG. 1.

Referring first to FIG. 2, the composite rectangular blank 10 from which the packet is made consists of a middle layer or substrate of paper 4, with inner and outer films of polyethylene 6 and 8 respectively laminated to the sides of the paper layer. The blank is folded into a tubular shape around a bundle of cigarettes (only part of the cigarettes C being shown) and the resulting overlapping longitudinal margins 12 at the left-hand side of the packet (as viewed in FIG. 1) are heat sealed, so that the opposing inner and outer films 6 and 8 of the over-lapping margins are bonded together.

The top closure is made in a conventional manner by tucking in the top sides 14 and folding down the resulting triangulated front and rear top flaps 16 18. (For simplicity FIG. 2 shows the top flap 16 without the underlying tucked folds). The bottom closure, not shown, is formed in a similar way. The top and bottom closures are also heat sealed, and this may be done at the same time as the longitudinal margins 12 are sealed.

Extending over the two flaps 16, 18 is a revenue stamp 20 secured only at its ends by adhesive to the front and rear faces of the packet.

Immediately to the right of the stamp 20 is a perforated line 22 formed in the flaps 16, 18 and extending slightly down the front and rear faces. Such perforations are only formed through the paper layer 4 and the inner film 6, the outer film 8 being unperforated to maintain the packet as airtight as possible. Extending around part of the front and rear faces and the right-hand side are two further perforated lines parallel to one another and defining between them a narrow band 24 terminating at the ends of the perforated line 22.

These parallel perforated lines again pass through the paper 4 and the inner film 6, but not through the outer film 8.

A tear strip 26 is formed integrally with the outer film 8, and has an opening tab 28 provided at the corner of the large face adjacent the longitudinal margin 12. The tear strip 26 is slightly wider than the narrow band 24, and passes along the front face and around the band 24, where it runs out at the end of the perforated line 22 on the rear face. Over the area of the band 24 the tear strip 26 adheres to the paper 4, but elsewhere it is prevented from adhering to the paper by means of a release agent 30 printed upon that part of the paper.

To open the packet the tear tab 28 is grasped and the strip 26 torn along the front face and through the front part of the stamp 20; on further pulling of the strip 26 it tears away the band 24, and finally it becomes detached from the packet at the rear end of the perforated line 22, thus removing the entire band. The resulting flap to the right of the line 22 can then either be hinged upwardly about the line 22 to gain access to the cigarettes, or can be torn completely away along the line 22 in the conventional manner.

If desired the line 22 may be positioned just under the stamp 20 so that the line is concealed. Alternatively the line may be provided diagonally across the rear corner, as shown chain dotted at 22A, in which case the band 24 and tear strip 26 would also terminate at that corner.

The thickness of the tear strip 26 is somewhat greater than for the adjacent outer film 8, as shown in FIG. 2, and the strip is bounded on each side by a line of weakness 32, followed by a narrow beading 34 to prevent the tear line propogating outside the respective line 32.

As an alternative to the construction shown, the tear strip 26 may extend fully around the top of the packet, terminating at the sealed margin 12, instead of at the rear end of the line 22. The area of the paper 4 covered by the tear strip between the margin 12 and the rear end of the line 22 is then also printed with a release agent, so that this area will not be torn away by the tear strip when opening the packet. In this case it is possible for the resulting constant sectional shape of the tear strip 26 to be provided on the paper 4 during manufacture of multiple adjoining blanks. Thus when the paper 4 has been printed with the release agent 30 and with the brand etc. of the cigarettes, it is fed past an extrusion die from which emerges the outer film of polyethylene. At the position where the tear strip is to be formed, the lips of the die are of a shape corresponding to that of the section of the tear strip 26 shown in FIG. 2, such that after stretching of the film by the faster moving paper the film is thinned out to the desired thickness and shape.

If preferred, the revenue stamp 20 may be shorter at the front face of the packet than shown, extending only down to the upper beading 34 of the tear strip 26. In this way the strip 26 can be torn open more easily, since it does not also tear the stamp 20.

In order further to simulate a conventional packet, in which the parts corresponding to the flaps 16, 18 are of aluminium foil, these areas may be printed with a metallised colour, for example gold.

The inner and outer films 6 and 8 could be made of materials other than polyethylene, notably of a cellulosic material, e.g. Cellophane (R.T.M.). Such a packet has the added advantage that when it is discarded it will be entirely degradable, including the metallised foil.

We claim:

1. A cigarette packet formed from a composite rectangular blank having an outer film of thermoplastic material laminated to a fibrous substrate, such as paper, said blank when erected providing two opposed large faces, two narrow sides, a sealed longitudinal seam extending down one of said faces or down a first one of said narrow sides, a top closure and a bottom closure, wherein:

(a) each of said closures is formed by tucking in material at the respective ends of the narrow dies and successively folding over and sealing together material at the respective ends of the large faces;

(b) a band is formed by spaced rows of perforations in said fibrous substrate below said top closure and extends across at least a second one of said narrow sides and across a part of one of said large faces; and (b) a tear strip is integrally formed in said outer film of thermoplastic material, said tear strip being thicker than the remaining outer film, being bounded by lines of weakness in said outer film and being secured over said band to enable said band to be torn open to gain access to the cigarettes in the packet.

2. A packet as claimed in claim 1, in which the outer film, including the tear strip, is formed continuously on multiple adjoining blanks by extruding the film on to the faster moving substrate, so that the film is stretched.

3. A packet as claimed in claim 1, in which the tear strip extends entirely around the packet below said top closure, and is releasably disposed on the substrate in the area remote from said band.

4. A packet as claimed in claim 1, in which the area of said top closure is printed with a metallised colour to simulate metal foil.

5. A composite rectangular blank for forming a packet as claimed in claim 1.

6. A packet as claimed in claim 1 further comprising a perforated line in said fibrous substrate and extending across said top closure and downwardly at opposite ends thereof to locations spaced from each other on said band, whereby when said band is torn away between said spaced locations a lid is formed which may be pivoted upwardly or torn from the remainder of said top closure along said perforated line.

7. A packet as claimed in claim 1 wherein said rows of perforations in said fibrous substrate forming said band do not extend through said outer film of thermoplastic material to maintain said packet airtight.

8. A packet as claimed in claim 1 wherein a narrow beading is provided in said film of thermoplastic material at the sides of said lines of weakness opposite said tear strip to prevent said tear lines from propagating into said film of thermoplastic material outside said lines of weakness when said tear strip is torn from the remainder of said film of thermoplastic material.

9. A packet as claimed in claim 1 wherein said rectangular blank further comprises an inner film of thermoplastic material laminated to said fibrous substrate.

* * * * *